US005209298A

United States Patent [19]

Ayres

[11] Patent Number: 5,209,298

[45] Date of Patent: May 11, 1993

[54] PRESSURIZED CHEMICAL INJECTION SYSTEM

[76] Inventor: Robert N. Ayres, 142 S. Cockren's Green Cir., The Woodlands, Tex. 77381

[21] Appl. No.: 830,599

[22] Filed: Feb. 4, 1992

[51] Int. Cl.[5] ..... E21B 37/06

[52] U.S. Cl. ..... 166/305.1; 166/90; 166/902

[58] Field of Search ..... 166/305.1, 307, 75.1, 166/90, 902, 91, 53

[56] References Cited

U.S. PATENT DOCUMENTS

| | | | |
|---|---|---|---|
| 1,645,686 | 7/1924 | Brady . | |
| 2,752,067 | 9/1952 | Kohl et al. | 222/80.5 |
| 2,801,697 | 8/1957 | Rohrbeck | 166/1 |
| 2,884,067 | 9/1958 | Marken | 166/75 |
| 3,228,472 | 1/1966 | Rhoads, Jr. | 166/64 |
| 3,700,031 | 10/1972 | Germer, Jr. et al. | 166/270 |
| 4,436,148 | 3/1984 | Maxwell | 166/53 |
| 4,582,131 | 4/1986 | Plummer et al. | 166/68 |
| 4,593,763 | 6/1986 | Burke | 166/302 |
| 4,796,697 | 1/1988 | Ayres | 166/310 |
| 4,830,112 | 5/1989 | Erickson | 166/312 X |
| 4,896,726 | 1/1990 | Ayres | 166/312 |

OTHER PUBLICATIONS

Containment Incorporated, "Spilguard System 55 & System 80".

*Primary Examiner*—William P. Neuder

[57] ABSTRACT

An apparatus and method for injecting chemicals into a hydrocarbon producing well is disclosed. The invention includes a valve attached to a vessel. A chemical is contained by the vessel, and a pressurized gas in the vessel pressurizes the chemical. The valve can be operated to selectively control the release of the chemical from the vessel and into the well. The pressurized gas drives the chemical through the valve and into the well without releasing the chemical into the ambient environment.

20 Claims, 1 Drawing Sheet

PRESSURIZED CHEMICAL INJECTION SYSTEM

FIELD OF THE INVENTION

The present invention relates to an improved apparatus and method for injecting chemicals into hydrocarbon producing well. More particularly, the present invention relates to a pressure vessel which contains the chemical and a pressurized gas which urges the chemical from the vessel and into the hydrocarbon producing well.

BACKGROUND OF THE INVENTION

In the production of oil, gas and other hydrocarbons, a tubing string is often positioned within the well casing. The hydrocarbons enter the tubing through perforations located at the lower end of a tubing string. In some wells, the hydrocarbons are pumped to the surface with a sucker rod pump located on the surface or with a downhole submersible pump. At the well surface, production equipment directs the hydrocarbon fluids to holding tanks or to a pipeline. The well production equipment typically comprises tubing, valves, piping, and other components.

The hydrocarbon fluids contain numerous compounds which adversely affect the well production equipment. For example, paraffins and water/oil emulsions can coat the well production equipment and eventually plug perforations in the tubing. In addition, chemical reactions between the hydrocarbon fluids and metallic equipment can cause scale to be formed on the well production equipment, and corrosive compounds in the hydrocarbon fluids can physically corrode the well production equipment.

Various techniques can treat these well conditions to extend the useful life of the well production equipment. In wells susceptible to paraffin build-up, "treater trucks" are regularly dispatched to pump hot oil into the well. The hot oil enters the casing, melts the paraffin deposits in the well production equipment, and returns to the surface through the tubing. For wells which are prone to corrosion and scale problems, high pressure injection trucks pump batches of chemicals into the well to chemically remove the scale, and to inhibit the causes of corrosion. All of these practices require regular maintenance services which are costly and which do not continuously treat the well. Batch treatment of wells is less efficient than continuous treatment because more chemicals are typically injected in batch treatment operations.

To avoid inefficiencies associated with treater truck maintenance of hydrocarbon producing wells, well operators use mechanical pumps to inject chemicals into a well. Typically, mechanical pumps are supplied from a storage tank which holds the chemicals. The mechanical pumps and storage tanks are located adjacent the well for several reasons, such as for reducing the length of the power cable connected to the pump. The tanks are located above the pump and the chemical is gravity fed to the intake port of the pump. These tanks include a vent at the upper end of the tank to prevent a vacuum from developing in the tank as the pump draws chemical from the tank. In addition, the vent releases excess pressure within the tank caused by thermal expansion of the chemical. Such thermal expansion can cause the chemical vapors to be released into the environment through the vent. In addition, thermal expansion can cause the chemical to be ejected through the vent or through the sight glass used to indicate the chemical level in the tank. In either event, chemical vapors or the chemical fluids are released in an uncontrolled manner and can pose a hazard to personnel and to the environment.

The mechanical pumps used in chemical injection systems are powered by electricity or gas and include numerous moving components. It is customary to inspect these pumps on a regular basis, sometimes daily, to verify the operability of the pumps. Because the chemical is gravity fed to the intake of the chemical pump, sediment in the tank or the chemical settles toward the pump intake and can interfere with the operation of the pump. In addition, the presence of an air bubble in the intake line may impede the operation of the pump because of a vapor lock. In such event, maintenance personnel routinely open a bleeder valve on the pump and release chemical from the pump until the air bubble has been cleared. This practice is undesirable because it releases chemical into the environment.

Presently available systems contain moving components which are subject to failure and require regular maintenance. Such systems are also undesirable because they vent chemicals into the environment. Accordingly, a need exists for a system which injects chemicals into a hydrocarbon producing well without moving components and without releasing the chemicals into the environment.

SUMMARY OF THE INVENTION

The present invention overcomes the limitations of the prior art by disclosing a closed system which can inject chemicals into well without using moving equipment. The invention includes a vessel for containing the chemical and a conduit for transmitting chemical between the vessel and the well. A valve in fluid communication with the conduit selectively controls the flow of the chemical from the vessel. A pressurized gas in the vessel causes the chemical to flow through the valve and into the well. The method of the invention comprises the steps of placing a pressurized gas into the vessel and of injecting the chemical into the vessel so that the pressurized gas exerts a pressure on the chemical. The valve is operated to selectively control the flow of chemical from the vessel and into the well.

DESCRIPTION OF THE PREFERRED EMBODIMENTS

Figure 1:
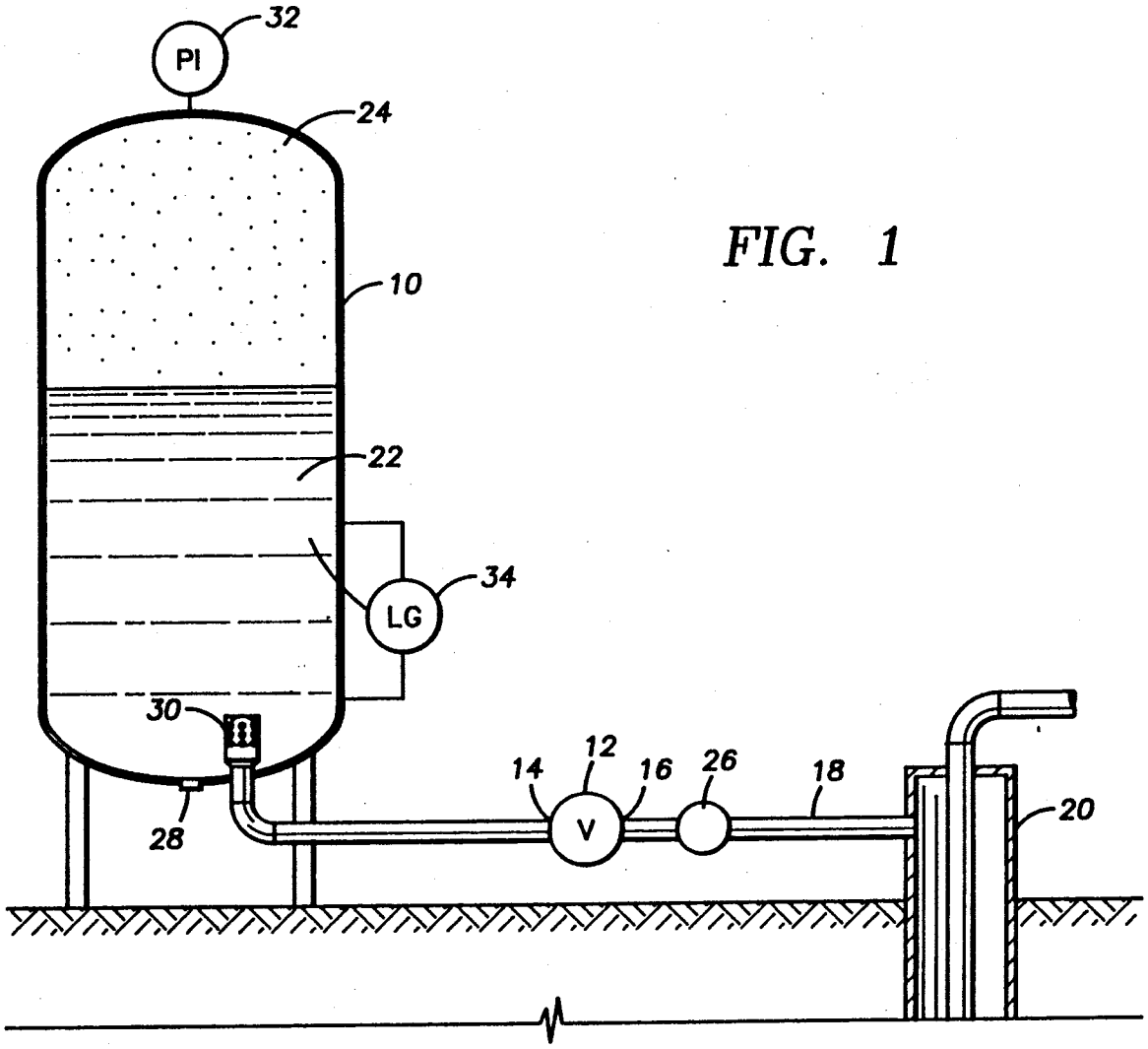
FIG. 1 illustrates a schematic view of the invention wherein a vessel containing chemical and a pressurized gas is positioned in fluid communication with a valve for selectively controlling the flow of the chemical into the well.

The present invention overcomes the limitations of the prior art by providing a unique apparatus and method for injecting a chemical into a hydrocarbon producing well. Referring to FIG. 1, vessel 10 comprises a container which is capable of holding an internal pressure without failure. Vessel 10 is distinguishable from containers such as tanks which are only designed to withstand the hydrostatic pressure exerted by the fluid in the tank. Preferably, vessel 10 is constructed from a fiberglass, stainless steel, epoxy resin, or other material resistant to degradation induced by chemicals and corrosive gases. Alternatively, vessel 10 can be constructed from a material which is coated with an inner lining (not shown) resistant to corrosion.

Valve 12 is attached to the lower end of vessel 10 and has an inlet end 14 in fluid communication with vessel 10. Valve 12 can comprise a micrometering valve which is adjustable to increase or decrease the flow rate. Outlet end 16 of valve 12 is connected to one end of conduit or fluid line 18, and the other end of fluid line 18 is attached to well 20. In another embodiment, fluid line 18 is connected between vessel 10 and well 20, and valve 12 is in fluid communication with line 18. A filter (not shown) can be installed in line 18 to prevent solid particles in chemical 22 from contaminating valve 12. In another embodiment, line 18 can be connected to the lower end of vessel 10 and can rise upwards so that gravity acts against any solid particles in chemical 22 to prevent the solid particles from entering valve 12.

Although well 20 can comprise a hydrocarbon producing well, the present invention is useful in other wells relating to the production of hydrocarbons such as injection wells used in enhanced recovery operations. As used throughout this disclosure, the terms "well" and "hydrocarbon producing well" will include all wells directly or incidentally associated with the production or injection of fluids containing hydrocarbons.

Chemical 22 is contained in vessel 10 in liquid form. As contemplated by the present invention, chemical 22 can comprise any liquid compound or material to be injected into a hydrocarbon producing well. As representative examples, without limiting the scope of the invention, chemical 22 can comprise chemicals generally identified as scale inhibitors, water clarifiers, demulsifiers, and other chemicals which inhibit the formation of chemical, organic, or metallic compounds in hydrocarbon producing wells.

As shown in FIG. 1, pressurized gas 24 is also located in vessel 10. Pressurized gas 24 preferably comprises a gas which does not chemically react with chemical 22, and may comprise readily available gases such as nitrogen, helium, argon, or carbon dioxide. Pressurized gas 24 is retained at a pressure which is less than the liquification pressure for such gas. These liquification pressures are commonly known for each gas, and are not exceeded within vessel 10 to prevent the possible mixing of liquified gas 24 with chemical 22. In addition, the density of pressurized gas 24 is preferably less than the density of chemical 22 so that chemical 22 is concentrated toward the lower end of vessel 10, and pressurized gas 24 is concentrated toward the upper end of vessel 10. As shown in FIG. I, pressurized gas 24 is in contact with chemical 22 and pressurizes chemical 22 to the same pressure as that of pressurized gas 24.

In operation, valve 12 is initially closed to prevent the release of chemical 22 from vessel 10. Valve 12 is then selectively opened and pressurized gas 24 urges chemical 22 through valve 12, through line 18, and into well 20. Preferably, valve 12 is adjustable to selectively control the flow of chemical into well 20. Valve 12 can be set to selectively adjust the flow rate into well 20, and to increase or decrease the flow rate of such chemical. This feature is an important feature of the present invention, since the precise injection rate of chemical 22 accomplishes several objectives. Certain wells require large volumes of chemicals to accomplish the desired function. Other wells require only relatively small quantities of chemicals to accomplish the desired results. For example, certain wells may require only a fraction of a gallon per day to accomplish the desired result, and the injection of additional chemicals is unnecessary to the operation of the well. If more chemical than required is injected into the well, the excess chemical will result in additional cost to the operator. The present invention selectively controls the flow rate of the chemical and eliminates unnecessary chemical consumption.

The present invention can be adjusted to control the flow of chemical in several different ways. In one embodiment of the invention, valve 12 continuously permits chemical 22 to exit vessel 10 and to enter well 20. The continuous feed embodiment is preferable to batch treatments known in the art, as it permits the continuous treatment of the well on a full-time basis. In certain applications, continuous treatment will prevent the occurance of corrosion or paraffin buildup before the corrosion or paraffin buildup begins to affect the performance of the downhole well equipment. This advantage is no presently realized by batch treatments because the chemicals are only injected during a small period relative to the total operation of the well. If desired, valve 12 can be configured to selectively permit a selected quantity, or batch, of chemical 24 into well 20. This feature can be accomplished by a timer mechanism (not shown) or mechanical device connected to valve 12.

Referring to FIG. 1, check valve 26 is installed in line 18 to prevent fluids in well 20 from back flowing into vessel 10. This feature is desirable because a well operator could accidentally pressurize well 20 to a pressure higher than that of chemical 22. Alternatively, this function could be incorporated into the design of valve 12. In addition, chemical inlet 28 is located in vessel 10 to permit the injection of chemical 22 into vessel 10. During such refilling, chemical 22 is injected under pressure into vessel 10. This injection under pressure is necessary to overcome the pressure exerted by pressurized gas 24. Preferably, chemical 22 should be injected into vessel 10 at a pressure greater that the pressure of pressurized gas 24, but is less than the liquification pressure of pressurized gas 24. If the liquification pressure is exceeded, then the injection of chemical 22 into vessel 10 would cause pressurized gas 24 to liquify with the undesirable consequences set forth above.

Float 30 is located in vessel 10 to prevent pressurized gas 24 from exiting vessel 10. In one embodiment of the invention, float 30 has a density less than that of chemical 22 and is buoyant therein. As the level of chemical 22 is lowered in vessel 10 by releasing chemical 22 through valve 12, float 30 will be lowered in vessel 10. When float 30 reaches a selected position within vessel 10, at a point when the level of chemical 22 is reduced to a certain quantity within vessel 10, float 30 seals inlet 16 of valve 12 to prevent the release of pressurized gas into valve 12. This function can be accomplished in other ways other than by using float 30. For example, a sight glass (not shown) could be used to visually indicate the level of chemical 22 within vessel 10 so that valve 12 can be closed before pressurized gas 24 exits vessel 10. In other embodiments, mechanical, electrical, or electronic devices can be utilized to indicate the level of chemical 22 within vessel 10 or, alternatively, to otherwise prevent pressurized gas 24 from exiting vessel 10.

Pressure gauge 32 is attached to vessel 10 to measure the pressure of pressurized gas 24. Gauge 34 is attached to vessel 10 for measuring the quantity of chemical 22 in vessel 10. Gauge 34 can comprise many different embodiments such as sight glasses, electromagnetic switches, and other devices well-known in the art. In addition, gauge 34 could comprise a flow meter which measures the quantity of fluid flowing from vessel 10. When the fluid quantity flowing from vessel 10 is compared to the quantity of chemical 22 installed in vessel 10, the quantity of chemical 22 in vessel 10 at any point in time can be determined.

The present invention provides a novel method of injecting chemical into a hydrocarbon producing well. The invention controls the rate of chemical injection and can be adjusted to inject chemicals at large or small flow rates. The chemical is injected without the need for pumps or other mechanical devices which require maintenance and are subject to operational failure. The invention uniquely prevents the discharge of the chemical or pressurized gas into the environment by disclosing a closed injection system which does not contain vents and does not permit chemical releases into the environment. Because vessel 10 is closed, aromatic compounds in the chemical are not vented to the environment. The absence of a vent further reduces the risk of fire due to flammable chemicals and reduces the contact between chemical vapors and well personnel. Moreover, the invention permits the continuous injection of chemicals into the well, and prevents corrosion or undesirable deposits from accumulating in the well.

The present invention is particularly useful in remote or environmentally hostile regions. The absence of moving components reduces the maintenance required for the chemical injection system, in contrast to the regular care necessary for chemical pumps. Because the chemical is pressurized within the vessel, pressure changes in the chemical due to variations in the ambient temperature will be less significant than if the chemical was contained by a unpressurized storage tank. Consequently, the present invention is readily adaptable to offshore, arctic, and tropical environments. In offshore platforms, the invention furnishes significant flexibility in the deck location of the vessel. In arctic environments subject to intense cold, antifreeze can be blended with the chemical to prevent icing in the valve, pressure regulator, and flow lines. In arctic or tropical environments, it may be desirable to insulate certain components of the invention to minimize the effects of temperature extremes. The pressurized gas can further be used to automatically inflate balloons or markers connected to a vessel for supporting a vessel displaced into the water from an offshore platform, or for identifying the location of the vessel after it has been otherwise displaced from a well site.

The embodiments of the invention shown herein are illustrative only, are made for the purpose of describing certain embodiments of the invention, and do not limit the scope of the invention. It will be appreciated that numerous modifications and improvements may be made to the inventive concepts herein without departing from the scope of the invention.

What is claimed is:

1. An apparatus for selectively injecting a chemical into a well, comprising:

a pressure vessel for containing the chemical, wherein said pressure vessel is closed to atmospheric pressure;

a conduit between said pressure vessel and the well for transmitting the chemical from said pressure vessel to the well;

a valve in fluid communication with said conduit for selectively controlling the flow of chemical from said pressure vessel; and a pressurized gas in said pressure vessel for causing the chemical to flow into the well as said valve controls the flow of chemical from said pressure vessel.

2. An apparatus as recited in claim 1, further comprising means for preventing said pressurized gas from exiting said pressure vessel through said conduit.

3. An apparatus as recited in claim 1, further comprising a gauge for indicating the quantity of chemical in said pressure vessel.

4. An apparatus as recited in claim 1, further comprising a pressure gauge attached to said vessel for measuring the pressure of said pressurized gas in said pressure vessel.

5. An apparatus as recited in claim 1, wherein said valve controls the flow of the chemical to more than one well.

6. An apparatus as recited in claim 1, further comprising means for injecting chemical into said pressure vessel.

7. An apparatus as recited in claim 1, further comprising means for injecting a gas into said pressure vessel to increase the pressure of said pressurized gas.

8. An apparatus for continuously injecting a chemical into a well, comprising:

a pressure vessel for containing the chemical, wherein said pressure vessel is closed to atmospheric pressure;

an outlet attached to said pressure vessel for permitting the chemical to exit said pressure vessel;

a conduit connected between said outlet and the well for transmitting the chemical from said pressure vessel to the well;

a valve connected to said conduit for selectively controlling the flow of chemical from said pressure vessel;

a pressure gas in said pressure vessel for causing the chemical to flow into the well through said valve and said conduit; and means for injecting chemical into said pressure vessel.

9. An apparatus as recited in claim 8 further comprising means for sealing said outlet for preventing said pressurized gas from exiting said pressure vessel.

10. An apparatus as recited in claim 8, further comprising a filter for removing solids from said chemical before said chemical contacts said valve.

11. An apparatus as recited in claim 8, further comprising means for indicating the quantity of chemical within said pressure vessel.

12. An apparatus as recited in claim 8, further comprising a gauge for indicating the pressure of said pressurized gas.

13. An apparatus as recited in claim 8, wherein the flow rate of chemical into said well is maintained by said valve at a constant rate as said chemical level varies within said pressure vessel.

14. An apparatus as recited in claim 8, further comprising means connected between said valve and at least two wells for transmitting said chemical from said pressure vessel to said wells.

15. A method for injecting a chemical into a well, comprising the steps of:

placing a pressurized gas into a pressure vessel which is closed to atmospheric pressure;

injecting a quantity of chemical into the pressure vessel so that the pressurized gas exerts a pressure on the chemical; and operating a valve in fluid communication with the chemical and the well to selectively control the flow of the chemical into the well as the pressurized gas causes the chemical to exit the pressure vessel.

16. A method as recited in claim 15, wherein said valve maintains a constant flow of chemical into the well as the quantity of said chemical changes within said pressure vessel.

17. A method as recited in claim 15, further comprising the step of measuring the quantity of the chemical within said pressure vessel.

18. A method as recited in claim 15, further comprising the step of measuring the pressure of said pressurized gas within said pressure vessel.

19. A method as recited in claim 15, wherein said valve maintains a constant flow of chemical into the well as the pressure within the well changes.

20. A method as recited in claim 15, wherein said valve maintains a constant flow of chemical into the well a the pressure of said pressurized gas changes.

* * * * *